US005839295A

United States Patent [19]

Lehmann

[11] Patent Number: 5,839,295

[45] Date of Patent: Nov. 24, 1998

[54] REFRIGERATION/HEAT PUMP MODULE

[75] Inventor: Walter E. Lehmann, Winnipeg, Canada

[73] Assignee: Frontier Refrigeration and Air Conditioning Ltd., Winnipeg, Canada

[21] Appl. No.: 800,197

[22] Filed: Feb. 13, 1997

[51] Int. Cl.[6] ..... F25B 41/00

[52] U.S. Cl. ..... 62/498; 62/295

[58] Field of Search ..... 62/295, 238.6, 62/238.7, 430, 259.1, 467, 498

[56] References Cited

U.S. PATENT DOCUMENTS

| | | | |
|---|---|---|---|
| 2,931,192 | 4/1960 | Weinberg | 62/259.1 |
| 3,513,663 | 5/1970 | Martin et al. | 62/259.1 |
| 3,991,819 | 11/1976 | Clark | 165/29 |
| 4,205,532 | 6/1980 | Brenan | 62/115 |
| 4,809,521 | 3/1989 | Mokadam | 62/498 |
| 4,862,707 | 9/1989 | Hill et al. | 62/431 |
| 5,070,708 | 12/1991 | Malosh et al. | 62/295 |

*Primary Examiner*—William Doerrler

*Attorney, Agent, or Firm*—Adrian D. Battison; Murray E. Thrift

[57] ABSTRACT

A refrigeration/heat pump system comprises a compressor, condenser, evaporator and expansion valve all of which are mounted within a rectangular housing for convenient layout and accessibility. The condenser, evaporator and expansion valve are all oversized relative to the compressor so as to obtain modifications in the operating parameters and particularly a compression ratio of the compressor which is less than 4.5:1. This mismatch of the components surprisingly provides an enhanced efficiency of operations in tons/hp. The components are arranged in the housing with the compressor centrally of the housing, the evaporator along one side, the condenser along the opposed side and with the system connections in the rear wall. The electrical components are provided in a vertical compartment on one side of the front wall which can be accessed by an opening door. A removable panel in the front wall and in the rear wall allows access to the components.

18 Claims, 4 Drawing Sheets

REFRIGERATION/HEAT PUMP MODULE

The present invention relates to a refrigeration/heat pump module of the type comprising a compressor, evaporator and condenser all of which are mounted in a housing for communicating heat through a recirculating refrigerant to a liquid to be heated and extracting heat by the same refrigerant to a liquid to be cooled.

The present module is particularly but not exclusively designed for refrigeration for example for the cooling pipes of an ice rink, a cold room or a freezer with the extracted heat being available for use in heating other areas. However the module can be used for general cooling and can use a geo thermal loop for disposing of the unwanted energy.

SUMMARY OF THE INVENTION

It is one object of the present invention to provide an improved module of this type which has a significantly improved efficiency of operation.

It is a second object of the present invention to provide a module of this type which has an improved layout of the elements for compact construction and ease of operation.

According to one aspect of the invention there is provided a refrigerator/heat pump module comprising:

a housing having a closed bottom, a closed top and four generally upstanding walls defining a closed interior, at least one of the walls having a removable panel for allowing access to the closed interior;

a first inlet and a first outlet for a liquid to be heated;

a second inlet and a second outlet for liquid to be cooled;

a compressor mounted in the closed interior for compressing and pumping a refrigerant;

a condenser having a plurality of parallel plates dividing the condenser into two paths between the plates, the condenser having a third inlet for refrigerant vapor, a third outlet for refrigerant liquid, a fourth inlet connected to the first inlet for the liquid to be heated and a fourth outlet connected to the first outlet for the liquid to be heated, the condenser being mounted within the closed interior;

an evaporator having a plurality of parallel plates dividing the evaporator into two paths between the plates, the evaporator having a fifth inlet for refrigerant liquid, a fifth outlet for refrigerant vapor, a sixth inlet connected to the second inlet for the liquid to be cooled, a sixth outlet connected to the second outlet for the liquid to be cooled, the condenser being mounted within the closed interior;

an expansion valve for releasing pressure in the refrigerant, and connecting piping connecting the fifth outlet of the evaporator to the input of the compressor, for connecting the outlet of the compressor to the third inlet of the condenser, for connecting the third outlet of the condenser to the expansion valve and connecting the expansion valve to the fifth inlet of the evaporator;

a capacity of the evaporator and a capacity of the condenser and a capacity of the expansion valve and a capacity of the piping begin selected relative to a capacity of the compressor such that a compression ratio of the compressor is maintained less than 4.5:1.

According to a second aspect of the invention there is provided a refrigerator/heat pump module comprising:

a housing having a closed bottom, a closed top and four generally upstanding walls defining a closed interior, at least one of the walls having a removable panel for allowing access to the closed interior;

a first inlet and a first outlet for a liquid to be heated;

a second inlet and a second outlet for liquid to be cooled;

a compressor mounted in the closed interior for compressing and pumping a refrigerant;

a condenser having a plurality of parallel plates dividing the condenser into two paths between the plates, the condenser having a third inlet for refrigerant superheated vapor, a third outlet for refrigerant subcooled liquid, a fourth inlet connected to the first inlet for the liquid to be heated and a fourth outlet connected to the first outlet for the liquid to be heat rejected, the condenser being mounted within the closed interior;

an evaporator having a plurality of parallel plates dividing the evaporator into two paths between the plates, the evaporator having a fifth inlet for refrigerant liquid, a fifth outlet for refrigerant vapor, a sixth inlet connected to the second inlet for the liquid to be cooled, a sixth outlet connected to the second outlet for the liquid to be cooled, the condenser being mounted within the closed interior;

an expansion valve for releasing pressure in the refrigerant, and connecting piping connecting the fifth outlet of the evaporator to the input of the compressor, for connecting the outlet of the compressor to the third inlet of the condenser, for connecting the third outlet of the condenser to the expansion valve and connecting the expansion valve to the fifth inlet of the evaporator;

wherein the housing is rectangular with a front panel in the front wall which can be removed to provide access to the closed interior.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
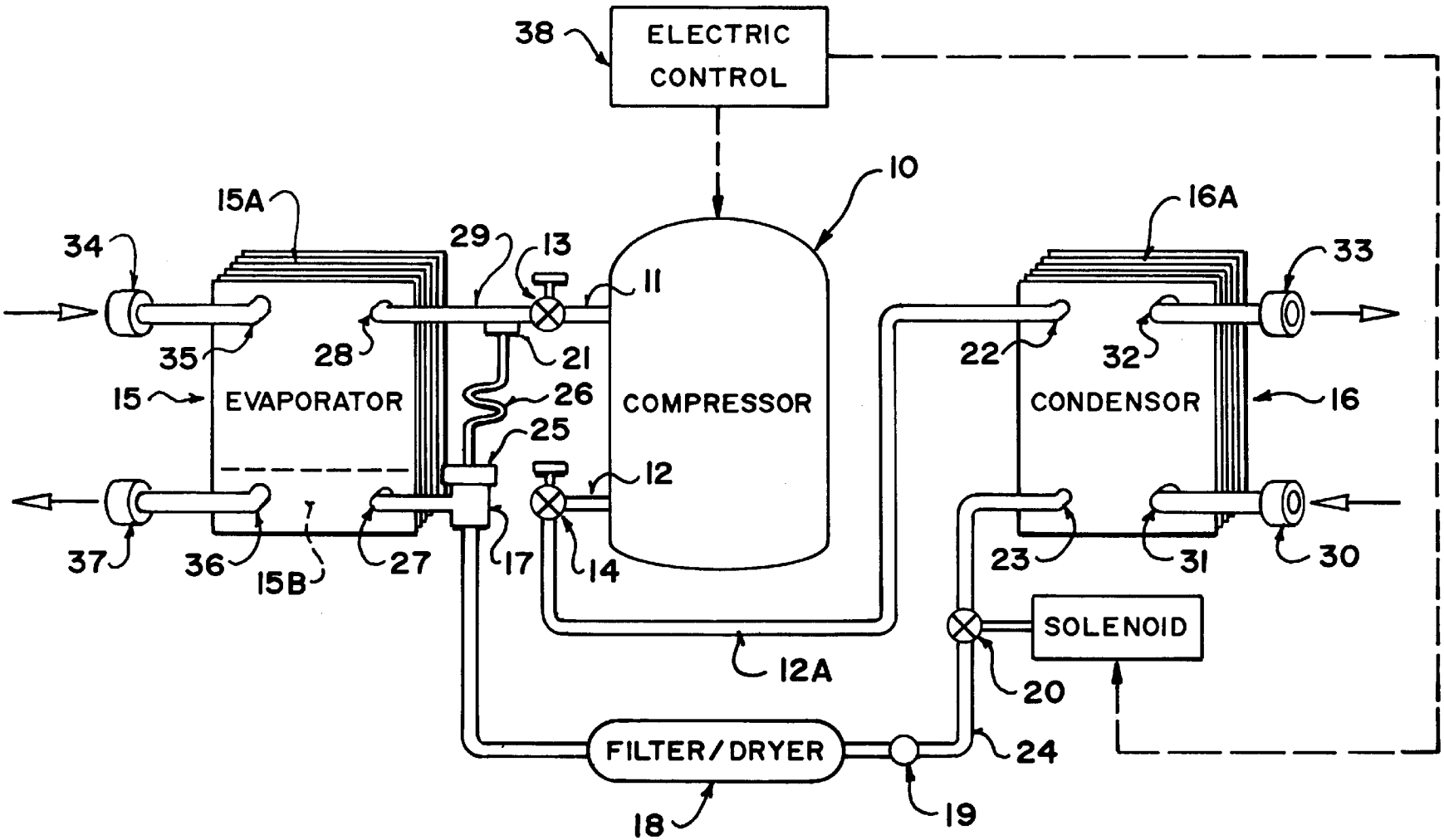
FIG. 1 is a schematic illustration of a refrigeration/heat pump system according to the present invention.
Figure 2:
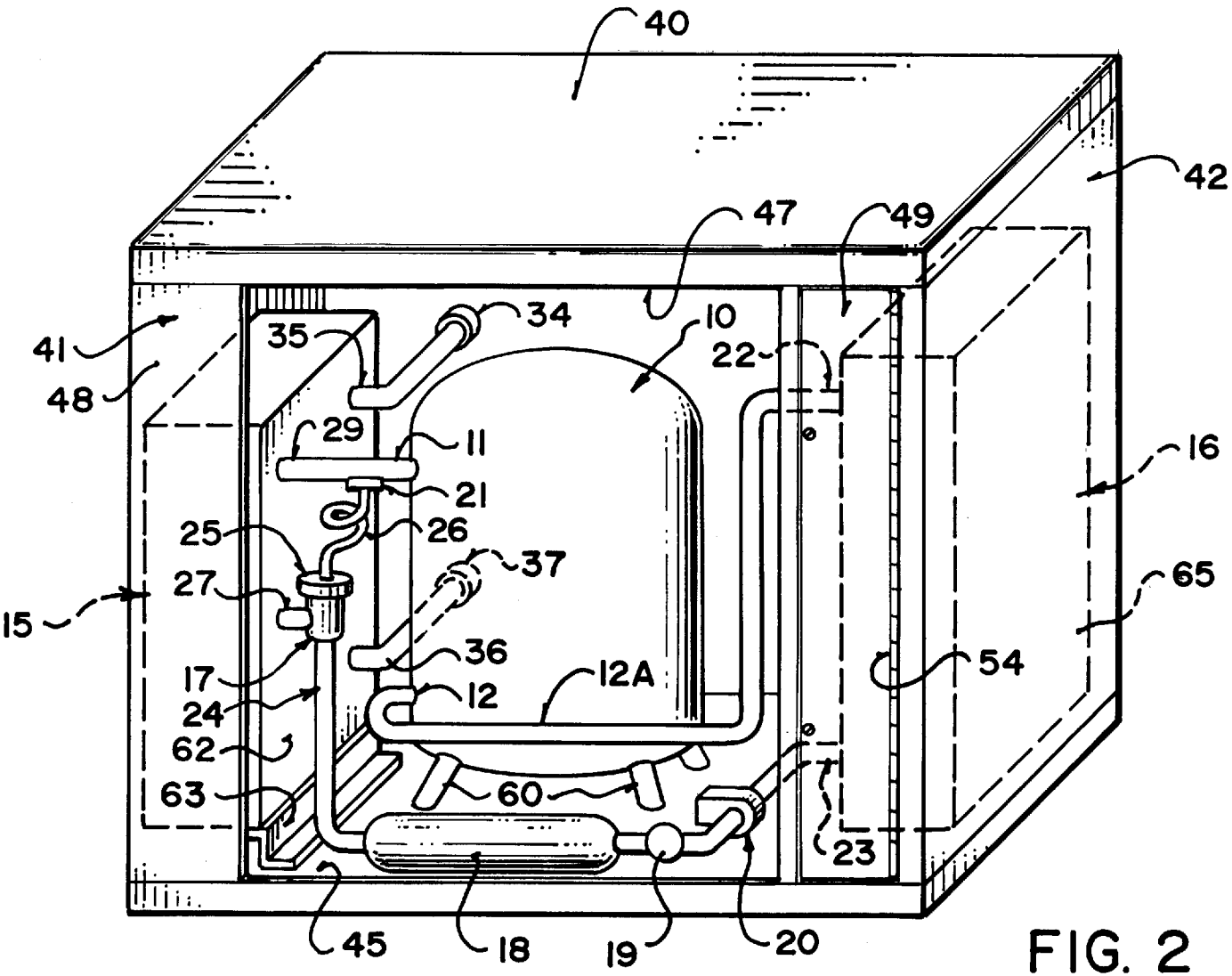
FIG. 2 is an isometric view of the elements of FIG. 1 mounted in a housing.

The refrigeration/heat pump system is shown in FIG. 2 mounted in the housing and the various elements are shown in layout form in FIG. 1. The apparatus comprises a compressor 10 of a conventional construction operable to compress vapor supplied at an inlet 11 and a discharge vapor at higher pressure at an outlet 12. Manually operable control valves 13 and 14 are provided at the inlet and outlet respectively for disconnecting the compressor from the system and allowing the compressor to be readily removed and replaced.

The apparatus further includes an evaporator and a condenser 16. Further the apparatus comprises an expansion valve 17, a canister type filter 18, a sight glass 19, a solenoid operated control valve 20 and a temperature control device 21.

The evaporator, compressor and condenser are arranged in conventional manner such that compressed vapor at the outlet 12 is supplied to an inlet 22 of the condenser and forms a condensate within the condenser discharging from the condenser through an outlet 23. The condensate from the condenser at the outlet 23 passes through a pipe 24 via the solenoid control valve 20 and the sight glass 19 through the filter 18 to the expansion valve 17 where the compressed liquid is expanded through an orifice. The dimension of the orifice or expansion valve is controlled by the temperature control device 21 which actuates a bellows type orifice control system 25 through a tube 26. The pressure in the liquid is thus released through the expansion valve and the liquid at lower pressure is supplied to an inlet 27 of the evaporator. Within the evaporator the liquid changes phased form a vapor so that the vapor discharges from the evaporator at an outlet 28 connected to the inlet 11 of the compressor by a pipe 29.

As is well known the condenser releases heat as the vapor changes phase to the liquid so that the condenser forms a heat exchanger with a liquid supplied at an inlet 30 which passes to an inlet 31 on the condenser so that heated liquid emerges at an outlet 32 of the condenser for connection to an outlet coupling 33 of the system.

Similarly the evaporator extracts heat from a liquid to be cooled which is supplied at a system inlet 34 for connection to an inlet 35 at the top of the evaporator so that the cooled liquid emerges at the bottom of the evaporator through an outlet 36 for connection to a system outlet 37.

The evaporator 15 is of the type employing a plurality of parallel flat plates 15A so that the materials passing through the evaporator are in intimate heat communication through the parallel plates. A suitable evaporator of the type concerned is manufactured by Flat Plate Inc. of York Pa. known as the "CH Series" liquid chiller. An evaporator of this type generally includes a distributor 15B at the bottom of the evaporator so that the liquid at the inlet 27 is effectively and equally distributed through the channels between the plates for passage through the evaporator in the most efficient manner.

The condenser 16 similarly is of the type manufactured by Flat Plate Inc. under the type "C Series" and includes a series of parallel plates 16A.

A suitable compressor is manufactured by Maneurop of Lawrenceville Ga. under product reference number MTE160HW.

The electrical components of the system are controlled by an electrical control system 38 which acts to control the motor of the compressor and the solenoid valve 20 in dependence upon requirements.

The present inventor has found that a significant improvement in efficiency of the system can be obtained as measured in tons of cooling per hp where one ton is equal to 12000 BTU at 45° F. Using the selection of components as set forth hereinafter, the efficiency of the system can be increased from the conventional value of 0.75 tons/hp up to 0.95 tons per hp and generally greater than 1.0 tons/hp at ice rink design temperatures.

The present inventor has identified that the selection of the above types of components that is the plate type evaporator and condenser when utilizing components which are significantly oversized relative to conventional systems in comparison with the capacity of the compressor.

Thus in one example a compressor of the order of 13.5 tons capacity is utilized in conjunction with a condenser having the capacity of 15 tons, an expansion valve having a capacity of 14 tons and an evaporator having a capacity of 20 tons.

While these components are conventionally mismatched, the present inventor has found that this selection of components provides a significant advantage in terms of efficiency. Thus the following characteristics of the system are obtained by this selection.

1. The compression ratio of the compressor is significantly reduced relative to conventional systems in that the compression ratio is reduced to a level less than 4.5:1 and preferably less than 3.4:1. Conventional systems run at a compression ratio of 7:1 to 10:1.

2. The temperature drop in the refrigerant across the condenser is maintained so that the temperature of the refrigerant emerging from the outlet 23 is less than 80° F. This compares with a conventional system having a temperature of the order of 90° to 120° F.

3. The super heat (that is the net difference between the temperature read out at the suction outlet of the evaporator and the pressure at the same point converted by the conventional calculations to temperature) of the refrigerant at the compressor is less than 8° F.

4. The temperature drop across the evaporator of the liquid to be cooled is less than 7° F. and preferably of the order of 6.6° F.

5. The temperature rise across the evaporator of the refrigerant is less than 10° F. and preferably of the order of 8° F.

6. The temperature rise across the condenser of the liquid to be heated is less than 10° F. and preferably of the order of 9.5° F.

7. The temperature drop of the refrigerant across the condenser is greater than 28° F. and preferably of the order of 30° F.

8. The temperature of the refrigerant at the fifth outlet is less than 80° F.

9. The pressure drop in the refrigerant across the evaporator is less than 8.9 PSIG.

10. The pressure drop of the refrigerant across the condenser is less than 11 PSIG.

Figure 3:
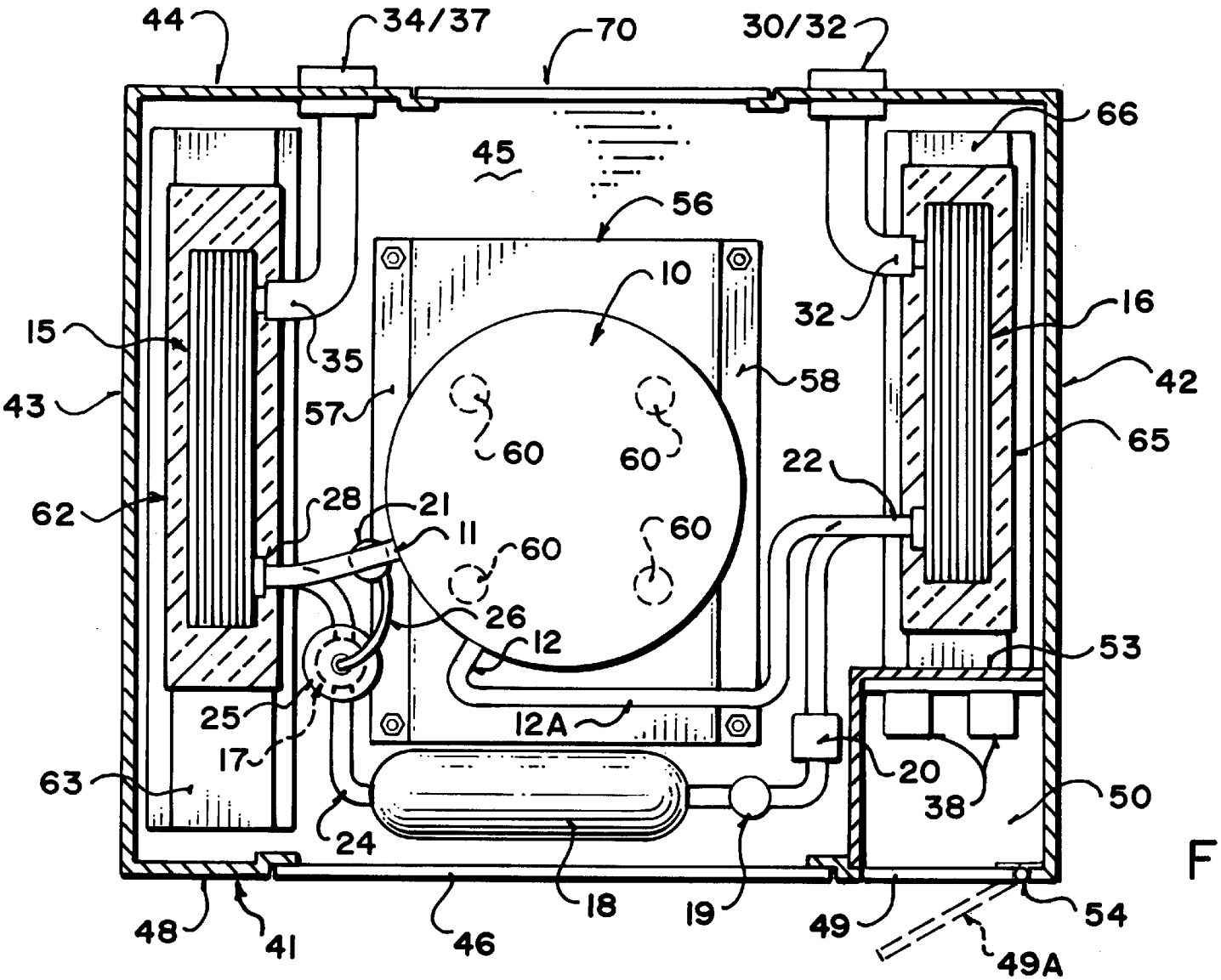
FIG. 3 is a horizontal cross sectional view through the apparatus of FIG. 2.
Figure 4:
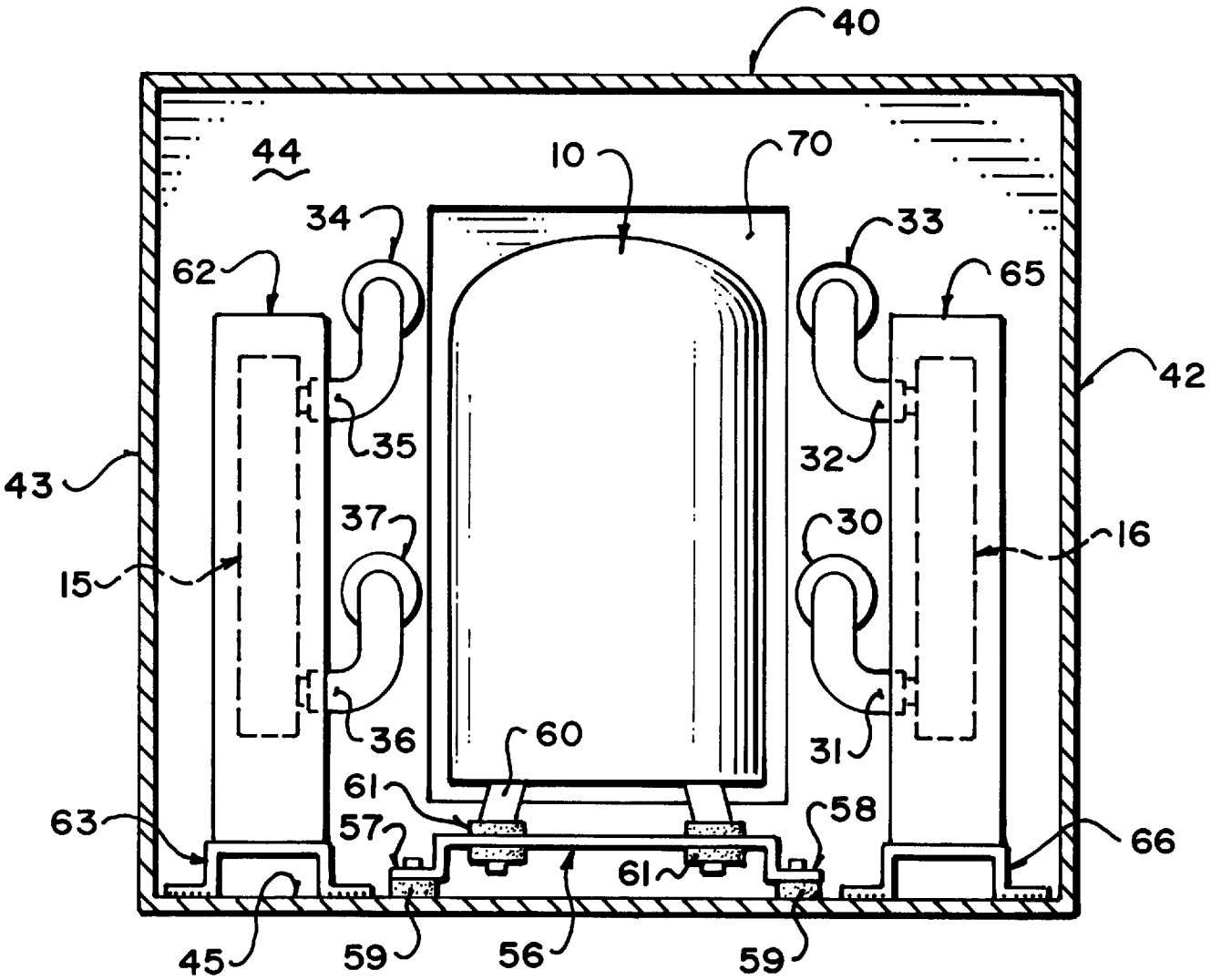
FIG. 4 is a vertical cross sectional view through the apparatus of FIG. 2.

Turning now to FIGS. 2, 3 and 4, the layout of the components of FIG. 1 in the housing is shown in more detail.

The housing comprises a rectangular body defined by a top wall 40, a front wall 41, side walls 42 and 43 and a rear wall 44 together with a base 45. The structure is formed from metal sheet to define a rigid self supporting transportable container which is stiffened by beams where necessary in accordance with good engineering practice.

The front wall 41 is defined by a rectangular front removable panel 46 which can be removed to define a rectangular opening 47 as shown in FIG. 2. Along one side of the panel 46 is defined a vertical strip 48. Along the opposed side of the panel 46 is defined a front door 49 covering a rectangular opening 50 defining a vertical housing for receiving the electrical components 38. Thus the housing 50 is defined in the corner between the front wall 41 and the side wall 42 and is enclosed by a side wall 51 parallel to the side wall 42 and a rear wall 53 parallel to the front wall 41 and the front door 49. The front door 49 is hinged at 54 so that it can be moved to an open position 49A allowing access to the electrical components.

The compressor 10 is mounted centrally of the base 45 on a support tray 56. The tray 56 includes a horizontal support wall which is supported by a pair of flanges 57 and 58 each along a respective side of the wall 56 and each horizontal adjacent the base 45. The flanges 57 and 58 are attached to the base wall 45 by a vibration dampening rubber support 59.

The compressor 10 is mounted on four legs 60 each of which is bolted to support wall 56 and is attached thereto by double rubber resilient vibration dampening elements 61 arranged on top of and below the support wall 56. In this way the legs are vibration dampened relative to the support wall 56 and the support wall is vibration damp and relative to the base 45 thus isolating any vibration from the compressor and reducing the noise level of the components.

The evaporator 15 is mounted within an insulated container 62 carried on a support tray 63 similar to the support tray 56. However the support tray 63 is simply welded to the base 45. The evaporator 15 is mounted in fixed position within the insulated interior of the container 62 and the ducts communicant to and from the evaporator pass through a front face of the housing 62.

Similarly the condenser 16 is mounted within an insulated housing 65 carried on a tray 66 welded to the base 45. Again the ducts pass through a front face of the insulated housing 65 for communication with the condenser 16.

The housings 62 and 65 are thus arranged adjacent the side walls 43 and 42 respectively with the plates of the heat exchanger parallel to the side walls. The condenser is located centrally between the housings 62 and 65 allowing simple communication of the pipes from the compressor to the evaporator and condenser. Thus the pipe 24 containing the dryer 18 and the site glass 19 passes from the valve 17 vertically downwardly and then horizontally across the front of the housing in front of the compressor 10 and the tray 56. The pipe 24 then extends horizontally rearwardly and then upwardly for connection to the outlet 23 of the condenser. A pipe 12A from the outlet 12 of the compressor extends horizontally across in front of the compressor and then vertically upwardly and rearwardly for connection to the inlet 22 of the condenser. The pipe 29 extends from the top of the evaporator horizontally across the top of the compressor.

The first inlet 30 and the first outlet 33 are both provided on the rear wall 44 of the housing at vertically spaced positions on the side adjacent the condenser. Similarly the second inlet 34 and the second outlet 37 are located on the rear wall 44 at positions symmetrical with the first inlet and outlet and adjacent the evaporator 15. Thus the system connections 30, 33 and 34, 37 are conveniently located on the rear wall. The rear wall 44 includes a removable panel 70 in between the first and second inlets and outlets on the rear wall. Thus the servicing of the system can be effected readily by removing the front and rear panels 46, 70.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

It is claimed:

1. A refrigeration/heat pump module comprising:

a rectangular housing having a closed bottom, a closed top and four generally upstanding walls including a front wall and a rear wall defining a dosed interior, and including a front panel in the front wall which can be removed to provide access to the closed interior;

a first inlet and a first outlet for a liquid to be heated;

a second inlet and a second outlet for liquid to be cooled;

a compressor mounted in the closed interior for compressing and pumping a refrigerant;

a condenser having a plurality of parallel plates dividing the condenser into two paths between the plates, the condenser having a third inlet for refrigerant vapor, a third outlet for refrigerant liquid, a fourth inlet connected to the first inlet for the liquid to be heated and a fourth outlet connected to the first outlet for the liquid to be heated the condenser being mounted within the closed interior;

an evaporator having a plurality of parallel plates dividing the evaporator into two paths between the plates, the evaporator having a fifth inlet for refrigerant liquid, a fifth outlet for refrigerant vapor, a sixth inlet connected to the second inlet for the liquid to be cooled, a sixth outlet connected to the second outlet for the liquid to be cooled, the evaporator being mounted within the closed interior;

an expansion valve for releasing pressure in the refrigerant, and connecting piping connecting the fifth outlet of the evaporator to the input of the compressor, for connecting the outlet of the compressor to the third inlet of the condensers for connecting the third outlet of the condenser to the expansion valve and connecting the expansion valve to the fifth inlet of the evaporator;

a capacity of the evaporator and a capacity of the condenser and a capacity of the expansion valve and a capacity of the piping begin selected relative to a capacity of the compressor such that a compression ratio of the compressor is maintained less than 4.5:1;

and a compartment for electrical components mounted immediately rearwardly of the front wall adjacent one side wall, the compartment for electric components having a front door panel which can be opened along side said front panel and separately of the front panel.

2. The module according to claim 1 wherein one of the compressor and evaporator is arranged behind the compartment for electrical components adjacent to and parallel to the respective side wall.

3. The module according to claim 1 wherein the compression ratio is less than 3.5:1.

4. The module according to claim 1 wherein the super heat (that is the net difference between the temperature read out at the suction outlet of the evaporator and the pressure at the same point converted by the conventional calculations to temperature) of the refrigerant at the compressor is less than 8° F.

5. The module according to claim 1 wherein the temperature drop across the evaporator of the liquid to be cooled is less than 7° F. and preferably of the order of 6.6° F.

6. The module according to claim 1 wherein the temperature rise across the evaporator of the refrigerant is less than 10° F. and preferably of the order of 8° F.

7. The module according to claim 1 wherein the temperature rise across the condenser of the liquid to be heated is less than 10° F. and preferably of the order of 9.5° F.

8. The module according to claim 1 wherein the temperature drop of the refrigerant across the condenser is greater than 28° F. and preferably of the order of 30° F.

9. The module according to claim 1 wherein the temperature of the refrigerant at the fifth outlet is less than 80° F.

10. The module according to claim 1 wherein the pressure drop in the refrigerant across the evaporator is less than 8.9 PSIG.

11. The module according to claim 1 wherein the pressure drop of the refrigerant across the condenser is less than 11 PSIG.

12. The module according to claim 1 wherein the efficiency of the module is greater than 0.9 tons/HP.

13. The module according to claim 1 wherein the compressor includes a plurality of legs each of which is attached to a horizontal support plate and wherein there is provided between each leg and the horizontal support plate a rubber resilient mounting member and wherein the horizontal support plate is attached to the bottom wall and wherein there is provided between the horizontal support plate and the bottom wall a further rubber resilient mounting member.

14. A refrigeration/heat pump module comprising:

a rectangular housing having a closed bottom, a closed top and four generally upstanding walls including a front wall and a rear wall defining a closed interior;

a first inlet and a first outlet for a liquid to be heated;

a second inlet and a second outlet for liquid to be cooled;

a compressor mounted in the closed interior for compressing and pumping a refrigerant, a condenser having a plurality of parallel plates dividing the condenser into two paths between the plates, the condenser having a third inlet for refrigerant vapor, a third outlet for refrigerant liquid, a fourth inlet connected to the first inlet for the liquid to be heated and a fourth outlet connected to the first outlet for the liquid to be heated, the condenser being mounted within the closed interior;

an evaporator having a plurality of parallel plates dividing the evaporator into two paths between the plates, the evaporator having a fifth inlet for refrigerant liquid, a fifth outlet for refrigerant vapor, a sixth inlet connected to the second inlet for the liquid to be cooled, a sixth outlet connected to the second outlet for the liquid to be cooled, the evaporator being mounted within the closed interior, an expansion valve for releasing pressure in the refrigerant, and connecting piping connecting the fifth outlet of the evaporator to the input of the compressor, for connecting the outlet of the compressor to the third inlet of the condenser, for connecting the third outlet of the condenser to the expansion valve and connecting the expansion valve to the fifth inlet of the evaporator;

a capacity of the evaporator and a capacity of the condenser and a capacity of the expansion valve and a capacity of the piping begin selected relative to a capacity of the compressor such that a compression ratio of the compressor is maintained less than 4.5:1 ;

wherein the condenser is arranged adjacent to and parallel to one side wall, wherein the evaporator is located adjacent to and parallel to an opposed side wall;

wherein the compressor is located between the condenser and the evaporator;

and wherein there is provided a filter for the refrigerant having a cylindrical canister located in front of the compressor.

15. The module according to claim 14 wherein the compressor includes a plurality of legs each of which is attached to a horizontal support plate and wherein there is provided between each leg and the horizontal support plate a rubber resilient mounting member and wherein the horizontal support plate is attached to the bottom wall and wherein there is provided between the horizontal support plate and the bottom wall a further rubber resilient mounting member.

16. A refrigeration/heat pump module comprising:

a rectangular housing having a closed bottom, a closed top and four generally upstanding walls including a front wall and a rear wall defining a closed interior;

a first inlet and a first outlet for a liquid to be heated;

a second inlet and a second outlet for liquid to be cooled;

a compressor mounted in the closed interior for compressing and pumping a refrigerant;

a condenser having a plurality of parallel plates dividing the condenser into two paths between the plates, the condenser having a third inlet for refrigerant vapor, a third outlet for refrigerant liquid, a fourth inlet connected to the first inlet for the liquid to be heated and a fourth outlet connected to the first outlet for the liquid to be heated, the condenser being mounted within the closed interior;

an evaporator having a plurality of parallel plates dividing the evaporator into two paths between the plates, the evaporator having a fifth inlet for refrigerant liquid, a fifth outlet for refrigerant vapor, a sixth inlet connected to the second inlet for the liquid to be cooled, a sixth outlet connected to the second outlet for the liquid to be cooled, the evaporator being mounted within the closed interior;

an expansion valve for releasing pressure in the refrigerant, and connecting piping connecting the fifth outlet of the evaporator to the input of the compressor, for connecting the outlet of the compressor to the third inlet of the condenser, for connecting the third outlet of the condenser to the expansion valve and connecting the expansion valve to the fifth inlet of the evaporator;

a capacity of the evaporator and a capacity of the condenser and a capacity of the expansion valve and a capacity of the piping begin selected relative to a capacity of the compressor such that a compression ratio of the compressor is maintained less than 4.5:1;

wherein the first inlet and first outlet and the second inlet and second outlet are arranged at respective sides of the rear wall.

17. The module according to claim 16 wherein the rear wall includes a rear panel therein which is removable.

18. The module according to claim 16 wherein the compressor includes a plurality of legs each of which is attached to a horizontal support plate and wherein there is provided between each leg and the horizontal support plate a rubber resilient mounting member and wherein the horizontal support plate is attached to the bottom wall and wherein there is provided between the horizontal support plate and the bottom wall a further rubber resilient mounting member.

* * * * *